US010134416B2

(12) United States Patent
Florencio et al.

(10) Patent No.: US 10,134,416 B2
(45) Date of Patent: Nov. 20, 2018

(54) PRIVACY-PRESERVING ENERGY-EFFICIENT SPEAKERS FOR PERSONAL SOUND

(71) Applicant: Microsoft Technology Licensing, LLC, Redmond, WA (US)

(72) Inventors: Dinei Florencio, Redmond, WA (US); Zhengyou Zhang, Bellevue, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 54 days.

(21) Appl. No.: 14/709,453

(22) Filed: May 11, 2015

(65) Prior Publication Data

US 2016/0336022 A1 Nov. 17, 2016

(51) Int. Cl.

| | |
|---|---|
| ***H04R 3/02*** | (2006.01) |
| ***G10L 21/0272*** | (2013.01) |
| ***H04R 3/12*** | (2006.01) |
| ***G10K 11/00*** | (2006.01) |
| *H04R 27/00* | (2006.01) |

(52) U.S. Cl.

CPC ..... *G10L 21/0272* (2013.01); *G10K 11/002* (2013.01); *H04R 3/12* (2013.01); *H04R 27/00* (2013.01); *H04R 2217/03* (2013.01); *H04S 2420/01* (2013.01)

(58) Field of Classification Search

CPC .... H04R 5/00; H04R 2227/005; H04R 27/00; H04H 20/49; H04H 40/54; H04H 40/72; H04H 40/81; H04H 20/48; H04H 40/45; H04H 20/61; G10K 11/175; H03C 1/00; H03C 1/46; H03C 1/52; H03C 1/62; H03C 1/28–1/34; H03C 1/48; H04S 5/00;

(Continued)

(56) References Cited

U.S. PATENT DOCUMENTS 4,039,999 A * 8/1977 Weston ..... H04B 11/00 128/201.19

7,162,042 B2 1/2007 Spencer et al.

(Continued)

FOREIGN PATENT DOCUMENTS

| | | | |
|---|---|---|---|
| WO | 2004093488 | A3 | 3/2005 |
| WO | 2010140104 | A1 | 12/2010 |
| WO | 2012122132 | A1 | 9/2012 |

OTHER PUBLICATIONS

"International Preliminary Report on Patentability Issued in PCT Application No. PCT/US2016/027649", dated Sep. 12, 2016, 7 Pages.

(Continued)

*Primary Examiner* — Leshui Zhang

(74) *Attorney, Agent, or Firm* — Alleman Hall Creasman & Tuttle LLP

(57) ABSTRACT

The privacy-preserving energy-efficient speaker implementations described herein improve user privacy while a user is listening to audio and can reduce the energy necessary to output the audio. This can be done by using parametric speakers and/or traditional loud-speakers. Signal splitting and masking can be used to improve user privacy. Additionally, a signal modulation technique which significantly reduces power requirements to output an audio signal, especially in the context of using parametric speakers, can also be employed.

20 Claims, 9 Drawing Sheets

(58) Field of Classification Search
CPC . H04S 5/005; H04S 3/00; H04S 3/002; H04S 3/004; H04B 3/00; H04B 5/00
USPC ..... 381/1, 15, 16, 73.1, 77–85, 94.7, 381/71.1–71.14, 94.1–94.9; 700/94; 379/406.01–406.16
See application file for complete search history.

(56) References Cited

U.S. PATENT DOCUMENTS

| | | | | |
|---|---|---|---|---|
| 7,564,981 | B2 | 7/2009 | Croft, III | |
| 7,587,227 | B2 | 9/2009 | Cheung et al. | |
| 8,965,546 | B2 | 2/2015 | Visser et al. | |
| 2002/0146138 | A1* | 10/2002 | Kolano | H04R 1/323 381/77 |
| 2003/0118198 | A1 | 6/2003 | Croft et al. | |
| 2004/0005064 | A1* | 1/2004 | Griesinger | G01S 3/8083 381/17 |
| 2004/0037440 | A1 | 2/2004 | Croft, III | |
| 2004/0114770 | A1* | 6/2004 | Pompei | H04R 5/02 381/77 |
| 2007/0211574 | A1 | 9/2007 | Croft, III | |
| 2008/0159571 | A1 | 7/2008 | Hooley | |
| 2008/0240465 | A1* | 10/2008 | Shiraishi | H04B 1/385 381/94.7 |
| 2010/0246849 | A1* | 9/2010 | Sudo | H03G 3/32 381/94.1 |
| 2012/0076306 | A1* | 3/2012 | Aarts | H04R 3/14 381/17 |
| 2012/0148053 | A1* | 6/2012 | Tan | G10K 15/02 381/1 |
| 2012/0314872 | A1 | 12/2012 | Tan et al. | |
| 2012/0316869 | A1 | 12/2012 | Xiang | |
| 2013/0259254 | A1 | 10/2013 | Xiang et al. | |
| 2014/0050325 | A1 | 2/2014 | Norris | |
| 2014/0355765 | A1* | 12/2014 | Kulavik | H04S 7/302 381/17 |

OTHER PUBLICATIONS

Turtle Beach Corporation, "Virtual Reality Audio by HyperSound®", Retrieved on: Mar. 19, 2015, Available at: http://hypersound.com/hypersound_technology.php.

Woo-Seng, Gan, "Next Generation of Directional Sound Beam with Bass Enhancement and Beamsteering to Support New Interactive Digital Media Applications", Retrieved on: Mar. 19, 2015 Available at: http://www.ie.eee.ntu.edu.sg/research/descriptionprojects/Pages/DirectionalSoundBeam.aspx.

"First Written Opinion and Search Report Issued in PCT Application No. PCT/US2016/027649", dated Jun. 27, 2016, 15 Pages.

Wei, J., et al., Theoretical and Experimental Comparison of Amplitude Modulation Techniques for Parametric Loudspeakers, 128th Audio Engineering Society Convention Paper, May 25, 2010, London U.K.

* cited by examiner

PRIVACY-PRESERVING ENERGY-EFFICIENT SPEAKERS FOR PERSONAL SOUND

BACKGROUND

Traditional or conventional audio speakers or loudspeakers are designed to fill a space with sound. This allows for a shared audio experience. Often, however, a person wants to listen to audio in private. This is especially true when the person is using a mobile computing device in a public space. One way to provide private sound to a mobile user (e.g., on a laptop computer or tablet computing device) is by having the user wear headphones. The use of headphones precludes others from listening to the audio. For example, speech that the user or listener is listening to can be kept private.

Parametric speakers (i.e., producing sound from an ultrasonic signal) also provide some level of privacy when used for various audio applications. They have been used to provide a "zone" where sound can be heard by a user that is listening to the audio, without disturbing others. A modulation technique traditionally used with parametric speakers is called square root modulation, and it is essentially equivalent to adding a Direct Current (DC) component to the desired signal (to make it non-negative), and then taking the square root of the results and using standard Amplitude Modulation-Suppressed Carrier (AM-SC) modulation.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In general, the privacy-preserving energy-efficient speaker implementations described herein improve user privacy while listening to audio and can reduce the energy necessary to output the audio, particularly when compared to parametric-only solutions. This can be done by using parametric speakers and/or traditional loudspeakers (e.g., conventional audio speakers). Signal splitting and masking can be used to improve user privacy. Additionally, a signal modulation technique which significantly reduces power requirements to output a signal, especially in the context of using parametric speakers, can also be employed.

In some signal privacy-preserving energy-efficient speaker implementations, a signal is divided into multiple complementary parts and one or more parts of the signal are output to one channel, while one or more other parts of the audio signal are sent to other channels in a manner that when the signals in each channel are played all parts of the resulting sound arrive at a desired destination at the same time. These implementations are applicable to various types of output devices. For example, the divided audio signal can be sent to a plurality of parametric speakers, to one parametric speaker and one traditional loudspeaker, to a plurality of parametric speakers and a plurality of loudspeakers, or to other types of output devices. Additionally, the divided signal parts can be sent at different times and then reassembled so that the listener can hear the sound produced by the reconstructed audio signal at a later time. For example, the complementary signals can be sent over a series of phone calls and then the complementary signals can be reassembled so that they are heard simultaneously or near simultaneously by the listener.

In some privacy-preserving energy-efficient parametric speaker implementations, an audio signal is modulated in order to reduce energy consumption of a transducer that outputs the signal. This can be done by modulating carrier signals by an audio signal representative of sound to be heard by the ear of a listener while adding a low frequency signal to the to-be-modulated signals in a manner that reduces the energy required to output the audio signal.

Additionally, in some privacy-preserving energy-efficient speaker implementations the signal splitting aspects are combined with the signal modulation aspects, which allows for control of the balance between power consumption and privacy. Thus, in some privacy-preserving energy-efficient speaker implementations, part of an audio signal representing the sound to be heard by a user is channeled to one or more traditional loudspeakers, while part of the signal is channeled through one or more parametric speakers where the ultrasonic carrier signals are modulated by applying a modified audio amplitude modulation process as described later. In some implementations, the splitting is done in a way that minimizes the understandability of speech to others, while controlling the power required for the parametric speakers.

The privacy-preserving energy-efficient speaker implementations described herein are advantageous in that they preserve the privacy of a user listening to audio and in that they result in reduced energy consumption when parametric speakers are used to output an audio signal. This allows parametric speakers to be used despite their typically high power requirements and directionality of their sound that is generally not good enough to guarantee privacy. Furthermore, the energy-efficient frequency modulation described herein can be applied to not just ultrasonic carrier signals (such as those used with parametric signals), but also with radio frequency (RF) signals such as would be used with an AM radio. Additionally, by determining the location of the ear(s) of a user/listener and directing sound to them by using the parametric speakers, the computing device used to output the sound can be made smaller than if the location of the ear(s) was not determined.

DESCRIPTION OF THE DRAWINGS

The specific features, aspects, and advantages of the disclosure will become better understood with regard to the following description, appended claims, and accompanying drawings where:

DETAILED DESCRIPTION

Figure 1:
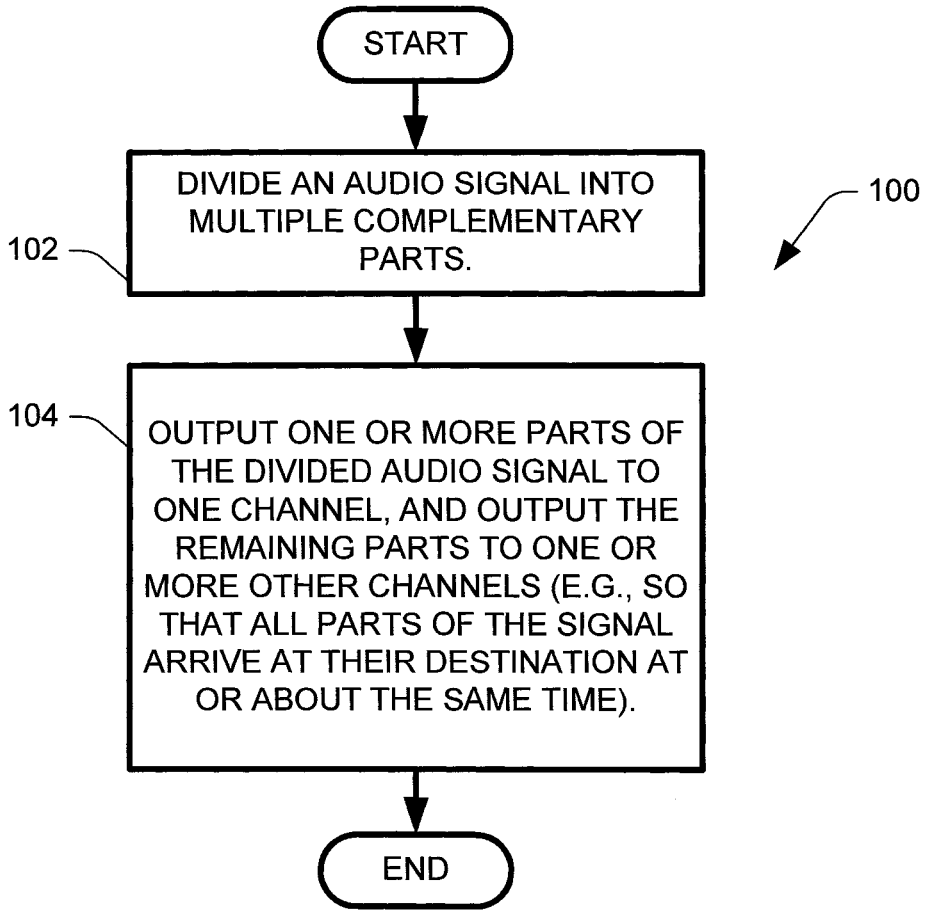
FIG. 1 is an exemplary process for practicing privacy-preserving energy-efficient speaker implementations that use signal splitting to obtain listener/user privacy while listening to audio.

In the following description of privacy-preserving energy-efficient speaker implementations, reference is made to the accompanying drawings, which form a part thereof, and which show by way of illustration examples by which implementations described herein may be practiced. It is to be understood that other implementations may be utilized and structural changes may be made without departing from the scope of the claimed subject matter.

1.0 Privacy-Preserving Energy-Efficient Speaker Implementations

The following sections provide descriptions of exemplary processes for practicing privacy-preserving energy-efficient speaker implementations described herein, as well as exemplary systems for practicing these implementations. Details of various embodiments and exemplary computations are also provided.

As a preliminary matter, some of the figures that follow describe concepts in the context of one or more structural components, variously referred to as functionality, modules, features, elements, etc. The various components shown in the figures can be implemented in any manner. In one case, the illustrated separation of various components in the figures into distinct units may reflect the use of corresponding distinct components in an actual implementation. Alternatively, or in addition, any single component illustrated in the figures may be implemented by plural actual components. Alternatively, or in addition, the depiction of any two or more separate components in the figures may reflect different functions performed by a single actual component.

Other figures describe the concepts in flowchart form. In this form, certain operations are described as constituting distinct blocks performed in a certain order. Such implementations are illustrative and non-limiting. Certain blocks described herein can be grouped together and performed in a single operation, certain blocks can be broken apart into plural component blocks, and certain blocks can be performed in an order that differs from that which is illustrated herein (including a parallel manner of performing the blocks). The blocks shown in the flowcharts can be implemented in any manner.

FIGS. 1 through 5 illustrate exemplary processes for practicing various privacy-preserving energy-efficient speaker implementations. While the processes are shown and described as being a series of acts that are performed in a sequence, it is to be understood and appreciated that the processes are not limited by the order of the sequence. For example, some acts can occur in a different order than what is described herein. In addition, an act can occur concurrently with another act. Further, in some instances, not all acts may be required to implement a process described herein.

Moreover, the acts described herein may be computer-executable instructions that can be implemented by one or more processors and/or stored on a computer-readable medium or media. The computer-executable instructions can include a routine, a sub-routine, programs, a thread of execution, and/or the like. Still further, results of acts of the processes can be stored in a computer-readable medium, displayed on a display device, and/or the like.

The processes described in FIGS. 1 through 5 can be used with one or more parametric speakers and/or loudspeakers that are in communication with a computing system. The computing system could be, for example, a mobile computing device, a mobile telephone, an audio receiver, a videogame console, an automobile, a set top box, a television, all which could include, or could be in communication with, the parametric speaker(s) and the loudspeaker(s). Each parametric speaker includes an array of piezoelectric transducers, which can be driven by the computing system to emit an ultrasonic beam. The computing system may include or be in communication with a sensor that is configured to output data that is indicative of a location of an ear (or locations of ears) of a listener relative to a location of the speakers. For example, the sensor can be or include a video camera that outputs images of the region that includes the listener and/or the sensor can be or include a depth sensor that outputs depth images of the region that includes the listener. Additional details of various systems that can be used to implement the processes shown in FIGS. 1 through 5 are provided with respect to FIGS. 6 through 9.

FIG. 1 depicts a process 100 for practicing one privacy-preserving energy efficient speaker implementation in which signal splitting is used. The signal splitting can be used to make audio output through speakers easy for an intended user/listener to understand but difficult for others in the vicinity of the user/listener to understand because they cannot hear all parts of the output audio. Referring to FIG. 1, an audio signal is divided into multiple complementary parts, as shown in block 102. Details of the how the signal is divided in some implementations are provided in Section 2.1. One or more parts of the audio signal are then output to one channel, while one or more other parts of the audio signal are sent to one or more other channels in a manner that when the signal in each channel is played all parts of the resulting sound arrive at a desired destination (e.g., at or about the same time), as shown in block 104. This signal splitting process can be implemented in various applications using various output devices. For example, the divided audio signal can be sent to a plurality of parametric speakers, to one or more parametric speakers and one or more traditional loudspeakers, or to other types of output devices, such as, for example, hearing aids, traditional loudspeaker arrays, etc. Additionally, the divided signal parts can be sent at different times and then be reassembled so that the listener/user can hear the sound produced by the signals at a later time. For example, the complementary signals can be sent over a series of phone calls and then the complementary signals can be reassembled so that the sound they generate is heard simultaneously or near simultaneously by the listener.

Figure 2:
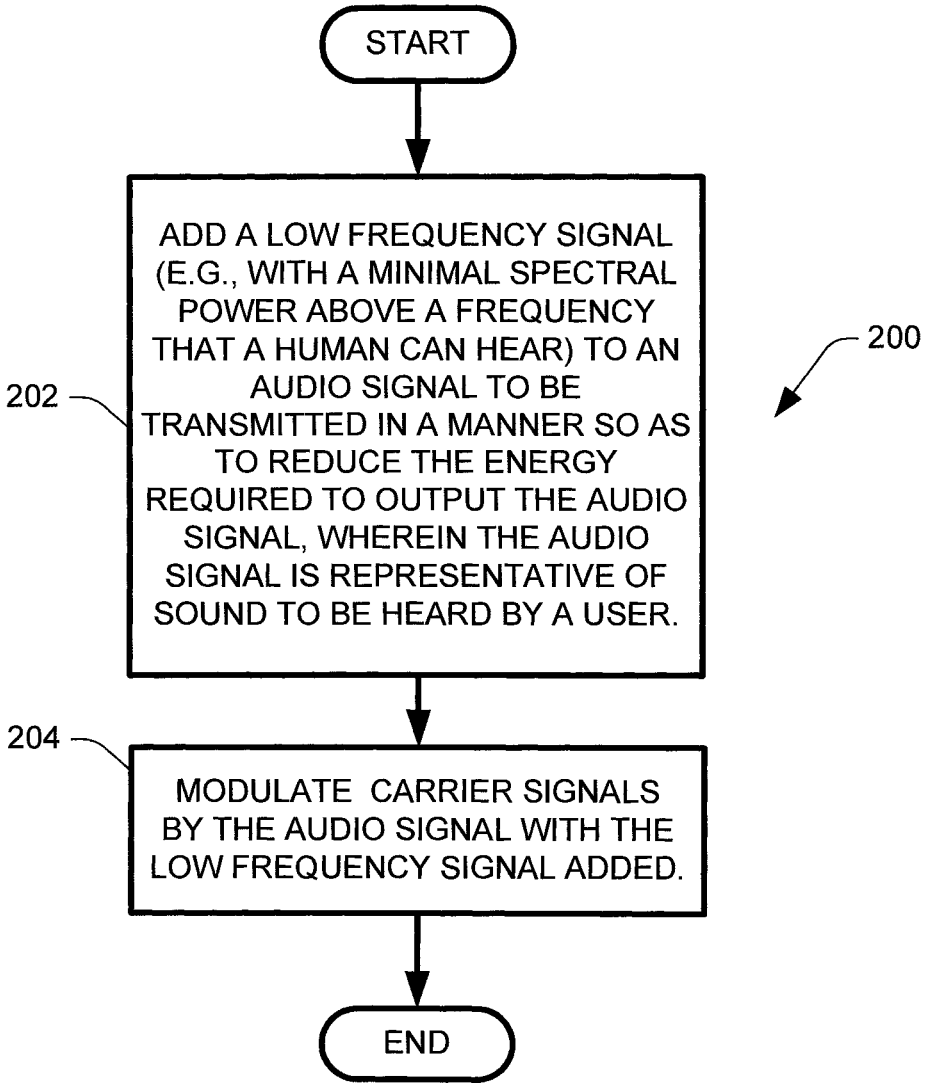
FIG. 2 is an exemplary process for practicing privacy-preserving energy-efficient speaker implementations that use a modified audio amplitude modulation process that reduces the energy necessary to output an audio signal.

In another exemplary process 200 for practicing a privacy-preserving energy-efficient speaker implementation, shown in FIG. 2, a low frequency signal is added to an audio signal before it is modulated. This is done in order to reduce energy consumption of a transducer that outputs the signal. As shown in block 204, this can be done, for example, by modulating carrier signals by an audio signal representative of sound to be heard by the ear of a listener. A low frequency signal is added to the original signals in a manner that reduces the energy required to output the audio signal, as shown in block 202. The low frequency signal can be chosen so that it has a minimal spectral power above a frequency that a human can hear. This modulation technique can be used with ultrasonic carrier signals that are used with parametric speakers but also can be used with radio frequency (RF) carrier signals such as can be used with an AM radio. The exemplary process 200 can be employed with various privacy-preserving and energy-efficient implementations in which signal splitting is also employed in order to provide both energy efficiency and user privacy.

Figure 3:
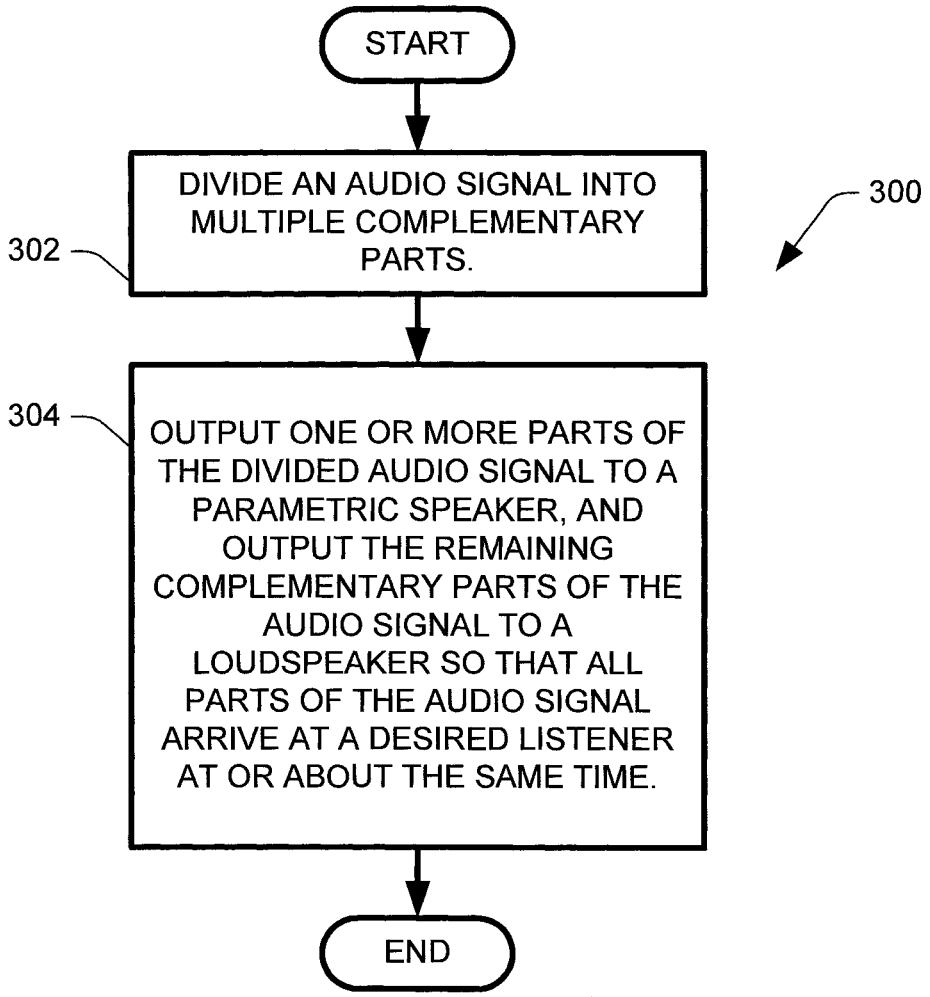
FIG. 3 is an exemplary process for practicing privacy-preserving energy-efficient speaker implementations that use signal splitting to split audio between one or more parametric speakers and one or more traditional loudspeakers.

Yet another exemplary process 300 for practicing a privacy-preserving energy-efficient speaker implementation, as shown in FIG. 3, facilitates the provision of sound to a parametric speaker, as well as provisioning part of the sound to be played through a conventional loudspeaker. As shown in block 302, an audio signal is split into multiple complementary parts. In block 304, one part of the audio signal is sent to the parametric speaker, while the remaining part is sent to the conventional loudspeaker in a manner that results in all parts of the sound produced arriving at the location of a desired user or listener at or about the same time. The splitting of the audio signal and sending complementary parts of the signal to different channels can be used to preserve the privacy of a user/listener because others around the user/listener cannot hear all parts of the sound produced by the complementary parts of the audio signal. Furthermore, the parts of the audio signal sent to the parametric speaker can be modulated in a manner such as to reduce the power requirements to output these parts. Such modulation is described in greater detail in Section 2.2.2.

Figure 4:
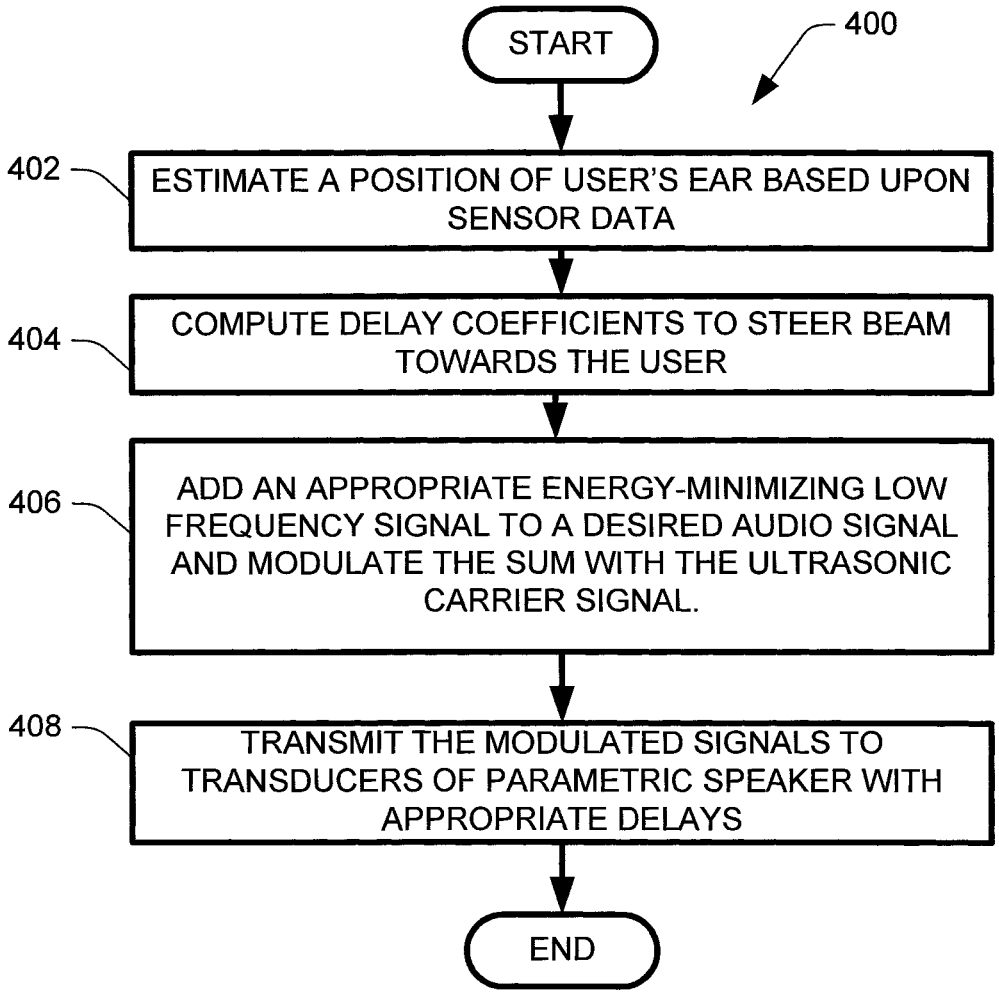
FIG. 4 is an exemplary process for practicing the privacy-preserving energy-efficient speaker implementations that use a modified amplitude modulation technique with a parametric speaker to reduce the power necessary to output sound from the parametric speaker.

Now referring to FIG. 4, an exemplary process 400 that facilitates driving a parametric speaker based upon a tracked location of an ear of a listener while applying a modified audio amplitude modulation method as described in more detail in Section 2.2.2 of this Specification is illustrated. As shown in block 402, a position of (an ear of) a user or listener is estimated based upon data output by a sensor that captures the position of a user/listener (for example, by using a head tracker). The sensor may be, or include, a camera, a depth sensor, or the like. In block 404, based upon the position of the ear of the user (estimated in block 402), delay coefficients for transducers of a transducer array of a parametric speaker are computed, wherein the delay coefficients are used to electronically steer a main lobe of an ultrasonic beam (output by the parametric speaker) to the ear of the user.

In block 406, ultrasonic carrier signals are modulated by an audio signal that is to be provided to the user, thereby creating modulated signals. Before modulation, the audio signal is added with an appropriate energy-minimizing low frequency signal which makes the resulting audio signal non-negative. This modulation with the low frequency signal reduces the power necessary to output the audio signal, as is described in greater detail in Section 2.2.2 of this specification. In block 408, the resulting signals are transmitted to the transducers in a transducer array of the parametric speaker, wherein the signals are delayed based upon respective delay coefficients computed in block 404.

Figure 5:
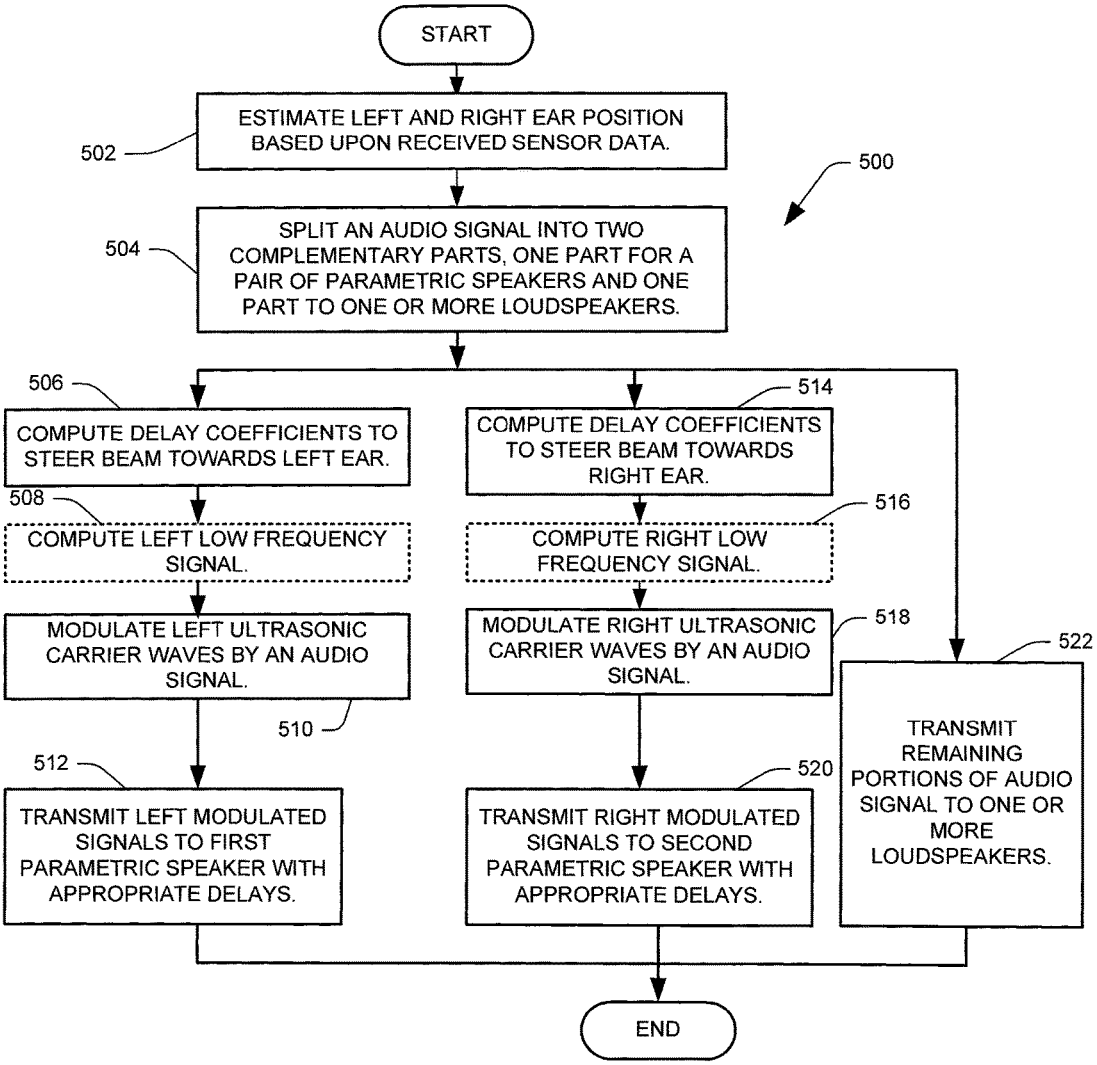
FIG. 5 is an exemplary process for practicing privacy-preserving energy-efficient speaker implementations that use signal splitting and a modified amplitude modulation technique to both provide privacy to a user listening to audio and to reduce the power consumed by the parametric speakers.

FIG. 5 depicts another exemplary process 500 that facilitates the provision of an audio signal to one or more parametric speakers, as well as provisioning part of the audio signal to one or more traditional loudspeakers (e.g., in or attached to the computing device). This signal provisioning can be used to make the audio output through the speakers easy for the intended user/listener to understand but difficult for others in the vicinity of the user/listener to understand. As shown in block 502, left and right ear positions of a user are estimated based upon received sensor data using conventional methods. The left and right ear positions can be relative to a first parametric speaker and a second parametric speaker, respectively. As shown in block 504, an input audio signal is split into two complementary parts, one part for a pair of parametric speakers and one part for one or more loudspeakers. The first part of the signal is processed for output by the pair of parametric speakers. The first part of the signal can be further divided into a left audio signal that is to be included in an ultrasonic beam output by the first parametric speaker and a right audio signal that is to be included in an ultrasonic beam output by the second parametric speaker. In block 506, delay coefficients are computed to cause the first parametric speaker to direct a main lobe of an ultrasonic beam to the left ear of the user, wherein such delay coefficients are computed based upon the estimated left ear position. In block 508, a low frequency signal that can be added to the ultrasonic carrier signals associated with the first parametric speaker (which will sometimes be referred to as the left parametric speaker) is computed. As shown in block 510, ultrasonic carrier signals for the left parametric speaker are modulated by the aforementioned first part of the audio signal, thereby creating left modulated signals for the left parametric speaker. The low frequency signal calculated in block 508 can be added to the audio signal before modulation by the ultrasonic carrier signals in one implementation in order to reduce the amount of power needed to output the signal. Details of this modulation are provided in Section 2.2.2 of this specification. In block 512, the left modulated signals are transmitted to respective transducers of the left parametric speaker, wherein the left modulated signals are appropriately delayed to arrive at the left ear of the user at the same time corresponding portions of the signal arrive at the right ear of the user based on the delay coefficients computed in block 506.

In parallel to acts shown in blocks 506-512, as shown in block 514, delay coefficients are computed to cause the second parametric speaker to direct a main lobe of an ultrasonic beam to the right ear of the user. As shown in block 516, a low frequency signal that can be added to the signals associated with the second parametric speaker (which will sometimes be referred to as the right parametric speaker) is computed. The ultrasonic carrier signals for the right parametric speaker are modulated by the first part of the audio signal, thereby creating right modulated signals for the right parametric speaker, as shown in block 518. The low frequency signal calculated in block 516 can be added to the audio signal before modulation by the ultrasonic carrier signals in one implementation in order to reduce the amount of power needed to output the signal. Details of this modulation are provided in Section 2.2.2 of this specification. As shown in block 520, the right modulated signals are transmitted to respective transducers of the right parametric speaker, wherein the right modulated signals are appropriately delayed to arrive at the right ear of the user at or about the same time corresponding portions of the signal arrive at the left ear of the user based upon the delay coefficients computed at block 514.

As shown in block 522, the second part of the audio signal is processed for simultaneous output of the second part of the audio signal by the traditional loudspeaker with the output of the first part of the audio signal by the parametric speakers. In a simplest example, the signal to be transmitted by the traditional loudspeaker can be computed as the originally desired audio signal, minus the one sent by the parametric speakers. More elaborate examples can include shaping the signals to compensate for frequency response of the parametric speaker. In any case, the distance between each speaker and the user's ears is estimated, and used in combination with the estimated speed of sound to compute the delays that need to be added to each component to guarantee all signals arrive at the user's ear at the appropriate time.

The result is that the user is provided with a high-quality stereo experience with audio delivered directly to the left and right ear of the user. It should be noted that a single parametric speaker can be driven to form two (or more) ultrasonic beams, directed towards, for example, the two ears of the listener. Additionally, the splitting of the audio signal and sending complementary parts of the signal to different channels can be used to preserve the privacy of a user/listener and reduce the energy needed to output the audio signal. For example, this can be achieved by sending high frequency portions of the audio signal to the parametric speakers which direct ultrasonic beams at the ears of the user, while sending low frequency portions of the signal, which require more energy to output, to the traditional loudspeakers. In some of the privacy-preserving energy-efficient speaker implementations a user can select the amount of privacy and the amount of energy efficiency desired. Additionally, in some privacy-preserving energy-efficient speaker implementations a masking sound can be output in order to further disguise the sound output through the parametric speakers. This masking sound can be output via one of the loudspeakers or via a separate speaker or sound generator. Generally any sound can be used as a masking sound. For masking speech, a babble sound where an energy envelope is modulated by the reverse of the energy envelope of the signal being masked may provide a great masking effect. Additionally, the masking signal may be output in a form that places a null at or near the user's ear, and a pole at the person who the masking is targeting.

Figure 6:
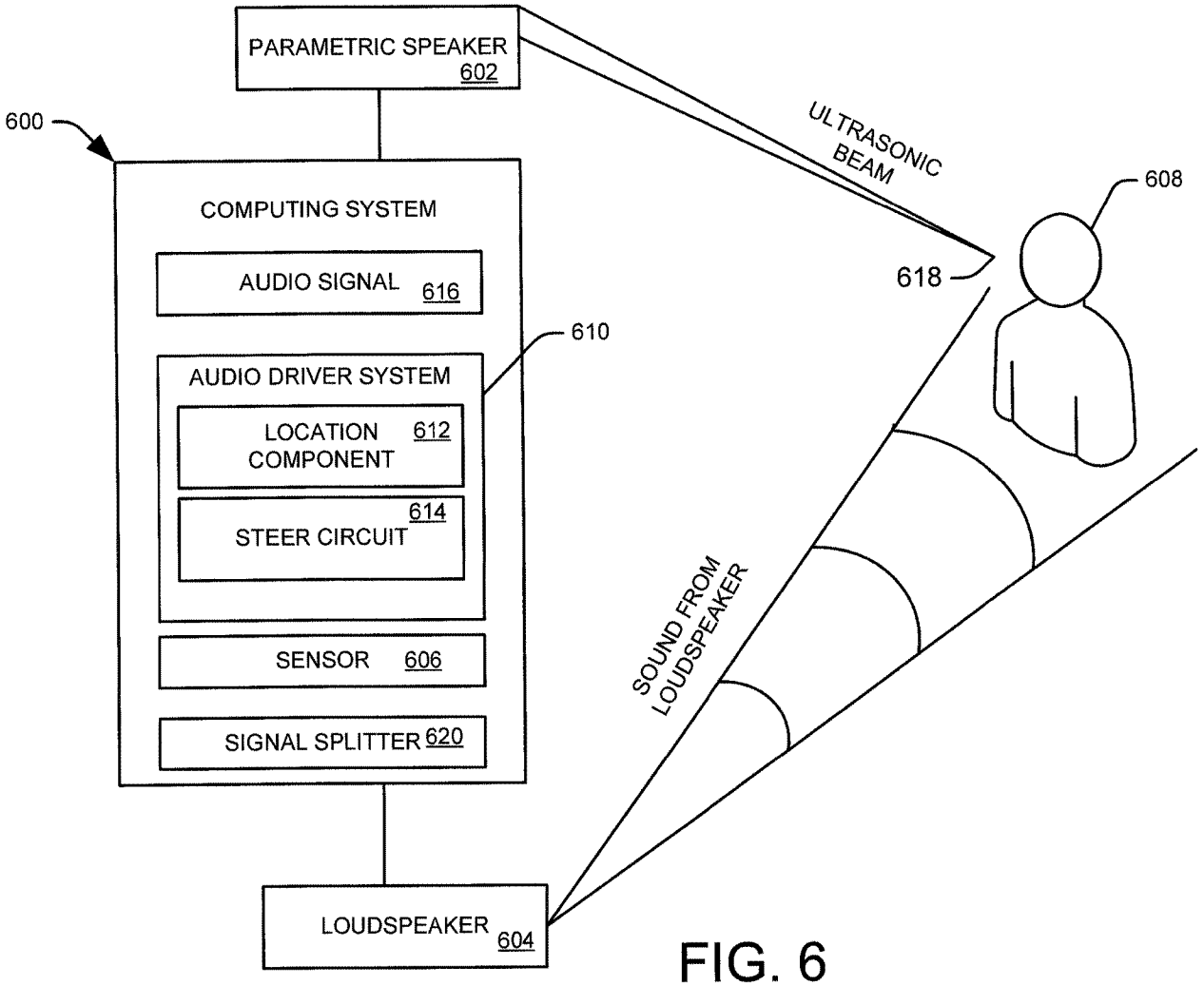
FIG. 6 is a functional block diagram of an exemplary system that facilitates directing an audio signal to an ear of a listener using a parametric speaker and a conventional loudspeaker using a signal splitter to provide privacy for a listener.

FIG. 6 depicts an exemplary computing system 600 that is configured to split an audio signal into one or more complementary parts and to drive a parametric speaker 602 and/or a traditional loudspeaker 604. The exemplary computing system 600 can be a computing system such as described in greater detail with respect to FIG. 9. Although the following description refers to one parametric speaker and one traditional loudspeaker for simplicity, additional parametric speakers and loudspeakers can be employed with the exemplary computing system 600.

Referring to FIG. 6, the parametric speaker 602 and the loudspeaker are in communication with the computing system 600, for example, by way of a wireless or wireline connection. In various implementations the computing system includes a mobile telephone in wireless or wired communication with the parametric speaker 602 and the loudspeaker 604, or an automobile that includes or is in communication with the parametric speaker 602 and a loudspeaker 604, or an audio receiver in communication with the parametric speaker 602 and the loudspeaker 604, or a videogame console that includes or is in communication with the parametric speaker 602 and the loudspeaker 604, or a television that includes or is in communication with the parametric speaker 602 and the loudspeaker 604, or a set top box that includes or is in communication with the parametric speaker 602 and the loudspeaker 604, or the like. The parametric speaker 602 includes an array of piezoelectric transducers (not shown), which can be driven by the computing system 600 to emit an ultrasonic beam. The traditional loudspeaker 604 can also output the audio signal, or portions thereof, through transducers (not shown) of the loudspeaker(s).

The computing system 600 may include or be in communication with a sensor 606 that is configured to output data that is indicative of a location of an ear (or locations of ears) of a listener 608 relative to a location of the parametric speaker 602. For example, the sensor 606 can be or include a video camera that outputs images of the region that includes the listener 608. Additionally or alternatively, the sensor 606 can be or include a depth sensor that outputs depth images of the region that includes the listener 608. In still yet another example, the sensor 606 can be or include stereoscopically arranged cameras that collectively output stereoscopic images of the region that includes the listener 608. Other sensors that can output data that is indicative of location(s) of listener(s) in a region that includes the parametric speaker 602 are also contemplated. The sensor 606 can output data that is indicative of location of the ear of the listener 608 relative to the sensor 604, and thus relative to the location of the parametric speaker 602 and the loudspeaker 604 (e.g., where the location of the parametric speaker 602 and the loudspeaker 604 are known or computed relative to the sensor 606 using conventional methods).

The computing system 600 may also include an audio driver system 610 that is configured to drive the parametric speaker 602 and/or the loudspeaker 604 based upon the location of the ear of the listener 608. The audio driver system 610 can include a location component 612 that computes location of the ear of the listener 608 relative to the location of the parametric speaker 602 and/or the loudspeaker 604 based upon data output by the sensor 606. For instance, the location component 612 can receive video images and/or depth images from the sensor 606, and can compute the location of the ear of the listener 608 based upon the video images and/or depth images. As the location of the parametric speaker 602 is known or computed, the location component 612 can compute the location of the ear of the listener 608 relative to the location of the parametric speaker 602 and/or the traditional loudspeaker 604.

The location component 612 can additionally or alternatively compute the location of the ear of the listener 106 based upon other data. For instance, the listener 608 may carry a mobile telephone, wherein the mobile telephone can be configured to identify its location. A GPS transceiver in the mobile telephone can output location of the mobile telephone to the computing system 612, which can compute the location of the ear of the listener 608 relative to the parametric speaker 602 based upon the location received from the mobile telephone. In another example, the listener 608 may wear eyewear that has computing functionality built therein, wherein the eyewear can compute data that is indicative of its location. The eyewear can then transmit this location to the computing system 600, and the location component 612 can compute the location of the ear of the listener 618 relative to the parametric speaker 602 and/or the traditional loudspeaker 604 based upon the location data received from the eyewear.

The audio driver system 610 can further include a steering component 614 that is configured to cause the parametric speaker 602 to dynamically form and steer an ultrasonic beam based upon tracked location of the ear of the listener 106 relative to the parametric speaker 602. In an example, the steering component 614 can generate drive signals that drive transducers in the transducer array in the parametric speaker 602, wherein the drive signals act to electronically steer the ultrasound beam towards the ear of the listener 608. In another example, the parametric speaker 602 may include actuators that are configured to mechanically move the transducers of the parametric speaker 602. The steering component 614 can generate drive signals that drive the actuators, such that an ultrasonic beam output by the parametric speaker 602 is mechanically steered based upon tracked location of the ear of the listener 608.

Additional detail pertaining to operation of the computing system 600 is now set forth. The computing system 600 can receive or retain an audio signal 616, which is representative of sound that is to be delivered to an ear of the listener 608. The audio signal 616 can be generated by the computing system 600 based upon an audio file retained on the computing system (e.g., an MP3 file, a WAV file, etc.). In another example, the audio signal 616 may be a streaming audio signal received from a computing device that is in network connection with the computing system 600. For example, the audio signal 616 can be received from a web-based music streaming service, a web-based video streaming service, etc. In yet another example, the audio signal 616 may be received by way of a telephone system (e.g., the plain old telephone system (POTS) or a web-based telephone system). In still yet another example, the audio signal 616 can be received from a broadcast source, such as a radio station, a television station, or the like.

The audio driver system 610 can receive the audio signal 616 and data from the sensor 606. The location component 612 identifies the current location of the ear of the listener 608 that is to receive the audio signal 616. The steering component 614 produces ultrasonic carrier signals for respective transducers in the parametric speaker 602. The steering component 614 then modulates the carrier signals by the audio signal 616 that is intended to be heard by the ear of the listener whose location has been identified by the location component 612, thus creating modulated signals. When the steering component 614 is configured to electronically steer an ultrasonic beam that is emitted from the parametric speaker 604, the steering component 612 can compute delay coefficients for the respective transducers in the parametric speaker 602. Pursuant to an example, the steering component 614 can compute the delay coefficients using the following algorithm.

$$\text{delay coefficient}_i = d_i \cos(\theta_i)/c, \quad (1)$$

where i refers to transducer i, $d_i$ is a distance from transducer i in the transducer array to the center of the array, $\theta_i$ is the angle between the vector from the center of the array to transducer i and the vector from the center of the array to the desired location, and c is the speed of sound.

The steering component 614 then drives the transducers of the parametric speaker 602 by transmitting the modulated signals, with delays based upon the computed delay coefficients, to the transducers of the parametric speaker 602. The parametric speaker 602, responsive to receiving the modulated signals, outputs an ultrasonic beam, where a main lobe of the beam is steered towards the ear of the listener 608.

When the parametric speaker 602 includes actuators that can mechanically move the steering component 614, the steering component need not compute the delay coefficients. Instead, the steering component 614 produces ultrasonic carrier signals and modulates the signals by the audio signal 616, thus generating modulated signals. The steering component 614 receives the location of the ear of the listener 608 relative to the parametric speaker 602 from the location component 612, and generates drive signals for the actuators based upon the received location. The steering component 614 transmits the drive signals to the actuators, and further transmits the modulated signals to the transducers of the parametric speaker 602. The actuators position the transducers of the parametric speaker 602 such that a main lobe of an ultrasonic beam formed by the transducers of the parametric speaker 602 is directed towards the ear of the listener 606. Thus, the steering component 614 can mechanically steer the ultrasonic beam.

In an example, as shown in FIG. 6, the steering component 614 can drive the parametric speaker 602 such that the ultrasonic beam has a focal point 618 that is between the parametric speaker 602 and the ear of the listener 608. This is in contrast to how ultrasonic beams are conventionally formed by parametric speakers. Specifically, conventionally, parametric speakers form ultrasonic beams such that the main lobe is fairly narrow and extends for as long as possible. In contrast, the audio driver system 610 can drive the parametric speaker 602 such that the main lobe of the ultrasonic beam has the focal point 618 near the ear of the listener 608 (e.g., between 2 inches and ¼ of an inch from the ear of the listener 106). Proximate to the focal point 618, ultrasonic waves emitted from the transducers of the parametric speaker 602 collide, thereby demodulating the audio signal proximate to the ear of the listener 608.

Furthermore, in an example, the parametric speaker 602 can output multiple ultrasonic beams directed towards different locations. For example, the parametric speaker can include a transducer array, wherein some transducers in the transducer array can be driven to direct an ultrasonic beam towards a first location (e.g., a first ear of the listener 608), while other transducers in the transducer array can be driven to direct an ultrasonic beam towards a second location (e.g., a second ear of the listener 608).

The computing system 600 can further include a signal splitter 620 that can split an audio signal into multiple complementary parts. Details of an exemplary splitting process that can be used to split the signal are provided in Section 2.1 of this Specification. Parts of the audio signal can then be sent to different channels so that they arrive at the ear of a listener 608 or user at or about the same time. More specifically, in one implementation an audio signal (e.g. speech signal) is split into two complementary parts. The first part is played through the (narrow beam) parametric speaker 602, while the second part is played through the traditional loudspeaker 604. The target user (e.g., listener) 608 will receive (hear) both parts, thus perceiving the signal as originally intended. Users outside the small "zone" where the sound played through the parametric speaker 604 is clearly heard by the listener 608 will receive the parametric speaker signal severely attenuated. In some implementations, the signal is split such that parametric speaker parts have significant comprehension importance, but relatively low power. Thus, a user outside the "zone" will not be able to understand the signal.

Figure 7:
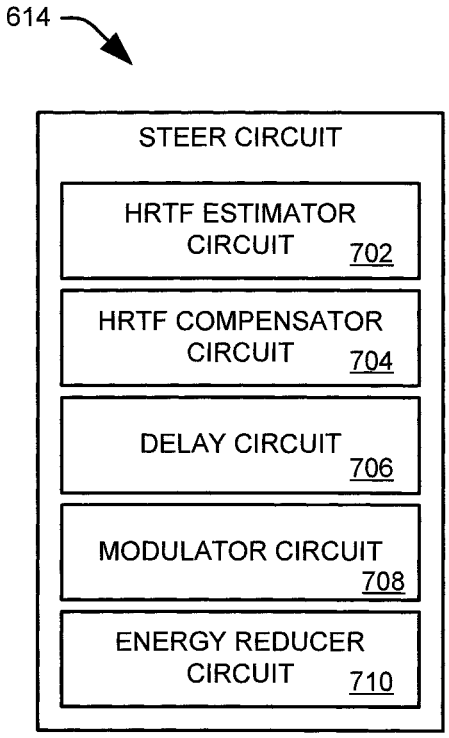
FIG. 7 is a functional block diagram of an exemplary steering component that is configured to steer a main lobe of an ultrasonic beam towards an ear of a listener.

Now referring to FIG. 7, a functional block diagram of the steering component 614 of FIG. 6 is illustrated. The steering component 614 can comprise a head related transfer function (HRTF) estimator component 702 that is configured to estimate a HRTF for an ear of the listener 608 (e.g., based upon the location of the ear of the listener 608 relative to the location of the parametric speaker 602). Additionally, the HRTF estimator component 702 can estimate a HRTF for another ear of the listener 608. A HRTF is a response that characterizes how an ear receives a sound from a point in space. A HRTF estimated by the HRTF estimator component 702 can be based upon a general model of human heads and/or bodies, or can be customized for the listener 608 (e.g., based upon images of the listener 608 output by the sensor 606).

The steering component 614 can also include a HRTF compensator component 704 that is configured to modify the audio signal 616 that is to be delivered to the ear of the listener 608 based upon an HRTF estimated by the HRTF estimator component 702. In an example, in some situations, it may be desirable for the listener 608 to perceive certain spatial effects typically associated with sound. When the parametric speaker 602 is configured to direct the main lobe of the ultrasonic beam to the ear of the listener 608, the spatial effects may be lost. Accordingly, the HRTF compensator component 704 can, for example, apply a HRTF estimated by the HRTF estimator component 702 to the audio signal 616, such that the listener 608 perceives the spatial effects that the listener 608 is accustomed to perceiving. Additionally, the HRTF compensator component 704 can cancel the HRTF associated with the position of the parametric speaker 602 relative to the ear of the listener 608. This canceling of the HRTF can cancel directionality perceived by the listener 608, such that the listener 608 can perceive that the sound is entering the ear canal at a direction orthogonal to the head orientation of the listener 608. In the example where two parametric speakers are used to direct independent ultrasonic beams to ears of the listener 608, HRTFs can be applied to left and right audio signals, thus creating a desired spatial effect from the perspective of the listener 608.

The steering component 614 also includes a delay component 706 that can be configured to compute delay coefficients for transducers of the parametric speaker 602, wherein the delay coefficients are used in connection with electronically forming and steering the ultrasonic beam emitted from the parametric speaker 602. Delay coefficients computed for transducers in the transducer array of the parametric speaker 602 can be a function of a desired direction of transmittal of modulated signal emitted by each transducer.

The steering component 614 also includes a modulator component 708 that can modulate carrier ultrasound waves by the audio signal 616. The steering component 614 may also optionally include an energy reducer component 710 that is configured to reduce an amount of energy needed to operate the parametric speaker 602. Generally, transmitting the ultrasonic beam requires that the carrier waves maintain a particular amplitude, even when the audio signal 616 by which the carrier waves are modulated require a relatively low amount of energy (e.g., there is a silent period in the audio signal 616). The energy reducer component 710 can add a relatively low frequency signal (below 20 Hz) to the audio signal to be modulated, which effectively reduces the amount of energy needed to transmit the carrier signals when there is a relatively small amount of energy in the audio signal 616. More specifically, in one implementation, the audio signal can be received by the energy reducer component 710, and the energy reducer component 710 can compute an envelope signal required for transmittal over some buffer period (time range). The energy reducer component 710 can utilize a rectifier and a low pass filter to compute the envelope. Based upon the size of the envelope, the energy reducer component 710 can insert a relatively low frequency signal into the modulated signal to make it always positive. This may be particularly beneficial in situations where the energy in the audio signal 616 is relatively low. Alternately, the modulated signal can be received by the energy reducer component 710, and the energy reducer component can look for the most negative sample in a segment of the signal and then add a window signal to this, such as, for example a (symmetric) Hanning window signal to compute the envelope. Based upon the size of the envelope, the energy reducer component can insert a relatively low frequency signal into the modulated signal, which effectively reduces an amount of energy needed to transmit the carrier signal. It should be noted that window signals other than a Hanning window signal can be used. For example, an asymmetric window signal can be used which can help speed up the signal processing, which is particularly beneficial in real-time signal processing applications. Details for modulating the carrier signals in these implementations are provided in Section 2.2.2 of this specification.

Figure 8:
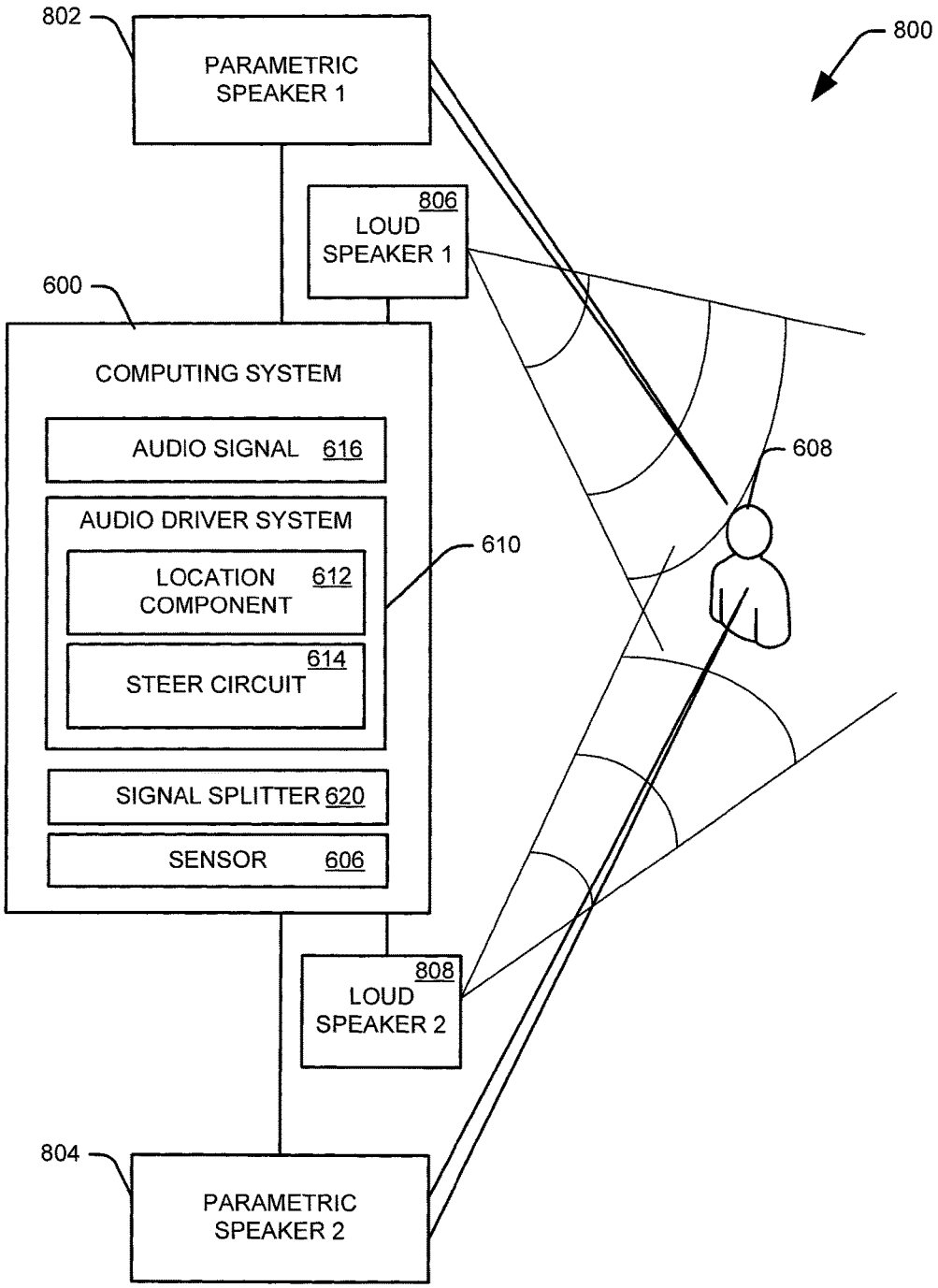
FIG. 8 is a functional block diagram of an exemplary system that can provide listener privacy and reduce the energy required to output an audio signal while providing a listener with a three-dimensional audio experience by directing audio signals to both ears of the listener using a set of parametric speakers and/or a set of traditional loudspeakers.

With reference now to FIG. 8, a functional block diagram of an exemplary system 800 that facilitates provision of a headphone-like experience to the listener 608 is illustrated. The system 800 comprises the sensor 606 and the audio driver system 610, which act as described above. In the system 800, the computing system 600 is in communication with a plurality of parametric speakers 802, 804, as well as one or more loudspeakers 806, 808. A signal splitter 620 can optionally be used to apportion complementary portions of the audio signal for output using the parametric speakers and portions of the audio signal to the loudspeakers.

In an example, it may be desirable for the first parametric speaker 802 to deliver sound to a first ear of the listener 608, while it may be desirable for the second parametric speaker 804 to deliver sound to a second ear of the listener 608. The shape of the user's/listener's head can be used to separate the sound received at the left ear from the audio signal received from the right ear of the listener. Furthermore, it may be desirable for the first loudspeaker 806 to deliver sound to one side or ear of the listener, while the other loudspeaker 808 delivers sound to the other side of the head or the other ear of the listener 608.

The location component 612 can receive data from the sensor 606 and can identify locations of the ears of the listener 608 relative to the first parametric speaker 802 and the second parametric speaker 804, respectively. The steering component 614 can receive: 1) a first audio signal (e.g., a left audio signal) that is to be included in an ultrasonic beam output by the first parametric speaker 802; and 2) a second audio signal (e.g., a right audio signal) that is to be included in an ultrasonic beam output by the second parametric speaker 804. For instance, the first audio signal and the second audio signal may collectively be a stereo audio signal. In another example, the first audio signal and the second audio signal may be identical signals (e.g., a mono signal).

The steering component 614 can produce first ultrasonic carrier signals for the first parametric speaker 802 and can generate second ultrasonic carrier signals for the second parametric speaker 804. The steering component 614 can modulate the first ultrasound carrier signals by the first audio signal and can modulate the second ultrasonic carrier signals by the second audio signal to create first and second modulated signals, respectively. A low frequency signal can be added to the audio signals before modulation in order to reduce the power required to output the sound through the parametric speakers 802, 804. Based upon the location of the first ear of the listener 608, the steering component 614 can drive the first parametric speaker 802 to direct a main lobe of a first ultrasonic beam (which includes the first modulated signals) to the first ear of the listener 608 (with a focal point of the main lobe of the first ultrasonic beam being between the first parametric speaker 802 and the first ear of the listener 608). Further, based upon the location of the second ear of the listener 608, the steering component 614 can drive the second parametric speaker 804 to direct a main lobe of a second ultrasonic beam (which includes the second modulated signals) to the second ear of the listener 608 (with a focal point of the main lobe of the second ultrasonic beam being between the second parametric speaker 804 and the second ear of the listener 608).

In conjunction with the distribution of sound to the parametric speakers, portions of the audio signal not output by the parametric speakers 802, 804 can be output using the loudspeakers 806, 808 so that all portions of the sound generated by the audio signal arrive at the user 608 at or about the same time.

It can thus be ascertained that the listener 608 can be provided with a relatively high quality stereo audio experience, as well as a headphones-like experience. Additionally, the splitting of the audio signal and sending complementary parts of the signal to different channels can be used to preserve the privacy of a user/listener and reduce the energy needed to output the audio signal. For example, this can be achieved by sending high frequency portions of the audio signal to the parametric speakers which direct ultrasonic beams at the ears of the user, while sending low frequency portions of the signal, which require more energy to output, to the traditional loudspeakers. In some of the privacy-preserving energy-efficient speaker implementations a user can select the amount of privacy and the amount of energy efficiency desired. Additionally, in some privacy-preserving energy-efficient speaker implementations a masking sound can be output in order to further disguise the sound output through the parametric speakers. This masking sound can be output via one of the loudspeakers or via a separate speaker or sound generator.

2.0 Exemplary Computations

The following paragraphs provide some exemplary computations for the signal splitting aspect and the signal modulation aspect of the privacy-preserving energy-efficient speaker implementations described herein.

2.1 Exemplary Signal Splitting Computations

One application of parametric speakers is for privacy preservation when devices are being used in public spaces. Parametric speakers allow the formation of a reasonably narrow beam, and steer that to the ear of a listener, thus limiting how much other people in the surroundings will hear the audio. Some privacy-preserving energy efficient speaker implementations described herein use a signal-splitting process, which divides an audio signal into complementary parts which are then sent to different channels in a manner that when the signals in each channel are played all parts of the resulting sound arrive at a desired location, such as an ear of a listener, at or about the same time. Using this process it is difficult for others to eavesdrop on the audio signal the user is listening to because it would require the capture of all channels. As discussed previously, some of the privacy-preserving speaker implementations combine the directivity of parametric speakers with the power efficiency of traditional loudspeakers. More specifically, one implementation splits an audio signal (e.g. speech) into two complementary parts. One of the parts is played through the (narrow beam) parametric speakers, while the second part is played through the traditional loudspeakers. The target user or listener will receive (hear) both parts, thus perceiving the signal as originally intended. Users outside the small "zone" where the transmitted signal can be accurately heard will receive the parametric speaker signal severely attenuated. This implementation splits the signal such that the parametric speaker parts have significant comprehension importance, but relatively low power. Thus, a user outside the "zone" will not be able to understand the audio.

The signal can be split into complementary parts in various ways. In one implementation the signal s(t) is split into the two parts, $s_t(t)$ and $s_p(t)$, corresponding to the traditional loudspeaker and the parametric speaker respectively. Human ears are most sensitive to frequencies around 2-5 KHz, with decreasing sensitivity below 1 KHz. Since the energy in typical speech signals is concentrated below 4 KHz, this implementation sends a small fraction of the high-frequency content to the parametric speaker(s), and the low-frequency content to the traditional loudspeaker(s). One process for splitting a signal into two parts is shown below. An explanation of an exemplary signal splitting process follows.

1) Given a signal s(t), Make r(t)=s(t), make $t_0=0$
2) Take an N-sample frame from r(t) starting a $t_0$, i.e., $f[n]=r(t_0+(1:N))$
3) Compute F[w]=FFT (f[n]) and the power spectrum $P(k)=[\text{abs FFT}[k]]^2$, f or k=0:N/2
4) m=N/2
5) Total_Power_in_PS_Frame=0;
6) Total_Power_in_PS_Frame=TotalPower_in_PS_Frame+P(m)
7) m=m−1;
8) if (m>−1 AND Total_Power_in_PS_Frame<=MAX_POWER) GOTO 6
9) Mask[w]=0 if w<m, or w>N−m; Mask[w]=1 otherwise
10) $f_p(t)$=IFFT (F[w].*Mask[w])
11) $f_t(t)=f(t)-f_p(t)$
12) $s_p(t_0+(1:N))=s_p(t_0+(1:N))+f_p(t)$.*Hanning(1:N)
13) $s_t(t_0+(1:N))=s_t(t_0+(1:N))+f_t(t)$.*Hanning(1:N)
14) $r(t_0+(1:N))=s(t_0+(1:N))-s_t(t_0+(1:N))-s_p(t_0+(1:N))$
15) $t_0=t_0+N/2$
16) (if end of signal not reached) GOTO 2

Where $f_p(t)$ and $f_t(t)$ are the frequencies sent to the parametric speaker and the traditional speaker, respectively.

In step 1, the signal s(t) is copied to a buffer. This signal, r(t), in this buffer initially is the same as the original signal s(t), but it gradually goes to zero as the signal is split and distributed into the portion going to the parametric speaker and the portion going to the traditional loudspeaker, $s_p$ and $s_t$ respectively. Processing of the signal starts at the beginning of the signal (by making $t_0=0$).

In step 2, an N-sample frame of r(t) starting at $t_0$ is selected (where N is the number of samples in the frame).

In step 3 the Fast Fourier Transform (FFT) and the power spectrum of that frame is computed.

In step 4 a loop variable is initialized, by making m=N/2.

In step 5 a power adder Total_Power_in_PS_Frame is initialized, by making Total_Power_in_PS_Frame=0.

In Steps 6 through 8 the signal is looped over, computing the cumulative power from the highest frequency up to the frequency index that corresponds to the maximum power that can be attributed to the parametric speaker, where P(m) represents the power of the current frequency.

In step 9 a mask Mask[w] is computed that will zero out the coefficients that will be sent to the traditional loudspeaker.

In step 10, the strongest signal (frame) that could be sent to the parametric speaker is computed.

In step 11 the remainder of the signal (frame) computed in step 9 is computed (i.e., the signal that should be sent to the traditional loudspeaker is computed).

In steps 12 and 13, the signal frame is accumulated by adding it to the previously computed frames. The signal frame is also multiplied by a Hanning window to smooth out the transition between frames.

In step 14 the parts of the signal that are already represented in $s_t$ and $s_p$ are subtracted from r(t).

In step 15 the pointer is advanced by a half frame.

In step 16, a check is made to see if the signal has ended, and if not, the processing advances to the next frame.

The signal splitting process described above is an exemplary process. There are a number of variations to this splitting process that will provide an equivalent effect. For example, instead of progressing from high to low frequency the signal can be split by a different frequency order. Likewise it is possible to vary the amount of energy apportioned to the parametric speaker. It is also possible to limit the signal by amplitude instead of power. In this case, an inverse FFT (IFFT) may have to be computed at each interaction step of the loop 6-8. Another variation is to split the signal according to an oracle that indicates which frequencies are more important for each phoneme. (after running a phoneme recognizer).

In some implementations it may be beneficial to equalize the frequency response of each of the speakers (e.g., parametric and traditional). More specifically, since speakers have a certain frequency response, this may be accounted for before playing out the signals. This is usually done applying a simple equalizer. In some implementations, the equalizer is accounted for when computing the power requirements (by, in step 6, inverse multiplying by the parametric speaker gain at the specific frequency m).

2.2 Exemplary Modified Audio Amplitude Modulation (MA-AM) Computations

Amplitude Modulation (AM) was one of the first modulation techniques used to transmit audio signals, and it is still in use today in AM radio. It essentially modulates the amplitude of a carrier (i.e., a higher frequency signal being used to transmit the information) according to the signal being transmitted. It allows for a simple decoder to receive (i.e., "demodulate") the signal.

For applications where the receiver is under control of the system, more efficient modulation techniques can be used. In particular, AM-Suppressed Carrier (AM-SC), and Single-Side Band (SSB) are good ways of improving modulation efficiency.

One of the AM applications pertains to parametric speakers. In this application, high power ultrasound is used as carrier (and modulated by the signal). The small nonlinearity of sound propagation in air is then used as the demodulator. As such, it is not possible to re-design the demodulator, and techniques like AM-SC are not an option. Yet, there is a need to reduce the power requirements. The implementations described herein therefore use a new modulation technique-Modified Audio Amplitude Modulation, (MA-AM)—which reduces the power requirement of traditional AM without requiring modification to the demodulator. This technique finds application not only in parametric speakers, but also in other areas where a simple decoder is needed or desired.

2.2.1 Amplitude Modulation Basics

Consider a signal s(t) and a desired carrier with frequency $f_c$. In traditional AM, the signal is normalized such that |s(t)|<1 for any time t, and used to modulate the carrier, i.e.:

$$M(t)=[s(t)+1]\cdot\sin(2\pi f_c t) \tag{2}$$

The key for simple demodulation is that the term in square brackets is always positive. This allows the receiver to decode the signal by simply tracking the envelope of M(t). This can be easily achieved, for example, by a rectifier followed by a low pass filter. In parametric speakers, this is achieved by the nonlinearity of the air propagation, and the low pass is performed by the human ear (which cannot hear above a certain frequency).

The power requirement for the transmitter is:

$$\begin{aligned} E\{M^2(t)\} &= E\{[s(t)+1]^2\}\cdot E\{\sin^2(2\pi f_c t)\} \\ &= 1+E\{s^2(t)\} \end{aligned} \tag{3}$$

Since |s(t)|<1 one must have that $E\{s^2(t)\}<1$. In practice $E\{s^2(t)\}<<1$. For example, even for a maximum amplitude sinusoid, $E\{s^2(t)\}=0.5$. In typical audio signals $E\{s^2(t)\}$ may be as low as 0.05. Thus, most of the power requirement comes from the "1" in equation (3). Even for segments when the signal being transmitted has no energy, the carrier still has to have an amplitude proportional to maximum amplitude the signal may ever take.

2.2.2 Modified Audio Amplitude Modulation

The following paragraphs describe a Modified Audio Amplification technique, MA-AM, that is employed in various privacy-preserving energy-efficient speaker implementations in order to reduce the power necessary to output an audio signal to one or more parametric speakers. In Eq. (2), all that is needed for proper demodulation is that the term in square brackets is non-negative. The simplest way of achieving that is by adding a Direct Current (DC) offset with an amplitude higher or equal to the most negative value of s(t). This is what is done in AM. However, this is not the only solution. In MA-AM the signal s(t) is modified by adding a low frequency signal b(t) such that s(t)+b(t)>0, while making sure b(t) does not have any significant energy above a certain frequency $F_{low}$. Since it is assumed that one cannot change the decoder, the decoded signal is now s(t)+b(t) instead of simply s(t). However, by making $F_{low}$ below the lowest frequency a human can hear (normally around 20 Hz), the new decoded signal is indistinguishable (by a human) from the original one.

In summary, one can characterize the MA-AM as:

$$M_{MAAM}(t)=[s(t)+b(t)]\cdot\sin(2\pi f_c t)$$

Where b(t) is chosen such that [s(t)+b(t)]>0, and the spectral power of b(t) above $F_{low}$ is minimal. Additionally, the power requirement will be E{[s(t)+bt2. Thus, b(t) should be chosen to minimize such power.

2.2.1.1 Computing b(t).

There are several ways of computing b(t). For example, it is possible to use the following process:

1. Make r(t)=s(t)
2. Find the first non-negligibly negative sample of r(t), i.e., min $\{t_f$ such that $r(t_f)<-\epsilon\}$. Grab a segment $u(t_f:t_{f+N})$ of u(t) with N samples.
3. Find the most negative sample of $u(t_f:t_{f+N})$, i.e., $u(t_0)$ such that $u(t_0)\leq u(t)\forall\in[t_f:t_{f+N}]$
4. Make $$r\left(t_0-\frac{N}{2}+(1:N)\right)=r\left(t_0-\frac{N}{2}+(1:N)\right)+(-u(t_0))\cdot w(1:N)$$

5. If min $\{r(t)\}<-\epsilon$ go to 2
6. Make $b(t)=s(t)-r(t)+\epsilon$ where $$w(n)=0.5-0.5\cos\left(2\pi\left(\frac{n}{N}\right)\right)$$

is a Hanning window. For a 16 KHz sampling rate, N=800 means the fundamental frequency of w(n) will be 20 Hz (and thus inaudible), but the harmonics may be audible. Even better quality will be achieved by longer windows.

A description of this process is as follows. In step 1 a copy of the signal s(t) is made (represented by r(t)).

In step 2, the first non-negligibly negative sample of r(t), $r(t_f)$, is found, i.e., the first sample such that $r(t_f)\leq-\epsilon$. And a segment $u(t_f:t_{f+N})$ of the frame u(t) with N samples is selected.

In step 3, the most negative sample of $u(t_f:t_{f+N})$ is found.

In step 4, A Hanning window is scaled by the most negative sample, and added to the signal. This will make that most negative sample be zero In step 5, r(t) is tested to verify whether all samples of r(t) are now above a small threshold $-\epsilon$. If not, one goes back to find the step 2.

In step 6, compute b(t) as $s(t)-r(t)+\epsilon$, where $\epsilon$ is a small value. Since all samples were verified in step 5 to be above $-\epsilon$, this will make b(t)+s(t) non-negative. The use of $\epsilon$ is only to increase processing efficiency.

Based upon the size of the envelope, the relatively low-frequency signal b(t) is inserted with the signal to be modulated.

2.2.1.2 Delay Considerations

For real-time applications, the window signal (w(n)) discussed in the paragraph above may imply a significant delay. This is due to the fact that the highest sample is at the center of the window. A person skilled in the art will know how to use an asymmetric window to reduce the induced delay.

2.2.2.3 Another Method of Computing b(t)

Other methods can be used to compute a non-negative signal s(t)+b(t). One of particular interest consists of the following procedure:

1) Make r(t)=s(t)
2) Make $r_n(t)=0.5[r(t)-abs(r(t))]$ (i.e., $r_n(t)$ is the negative part of r(t)).
3) Compute $r^{LP}(t)$=LowPass20 HzFilter$\{r_n(t)\}$
4) Make $r(t)=r(t)-r^{LP}(t)$
5) If min$\{r(t)\}<-\epsilon$ go to 2
6) Make $b(t)=s(t)-r(t)+\epsilon$.

where $r^{LP}(t)$ is the low frequency portion of the signal, 0.5[r(t)−abs(r(t))] is a rectifier, LowPass20 HzFilter$\{r_n(t)\}$ is a low pass filter and E is a small value. Essentially, this method of computing b(t) removes the negative portions of the signal using a rectifier and then determines an envelope signal required for transmittal over some buffer period (time range) by using a low pass filter. Based upon size of the envelope, the relatively low-frequency signal b(t) is inserted with the signal to be modulated.

2.2.3 Applications to Traditional AM Transmissions

The above-described MA-AM can be used nearly in all applications traditional AM can, with corresponding power savings. In particular, this can be used to transmit audio to AM radios and other equivalent devices. This modulation is increasingly useful in these areas as low-power and simplicity become even more important (e.g., in the Internet of Things (IoT) scenarios).

2.2.4 Application to Parametric Speakers

One target application for the MA-AM described above is reducing power for parametric speaker applications. In such case, after the non-negative signal is computed, the signal should be squared rooted before going through amplitude modulation, as in traditional parametric speakers.

Figure 9:
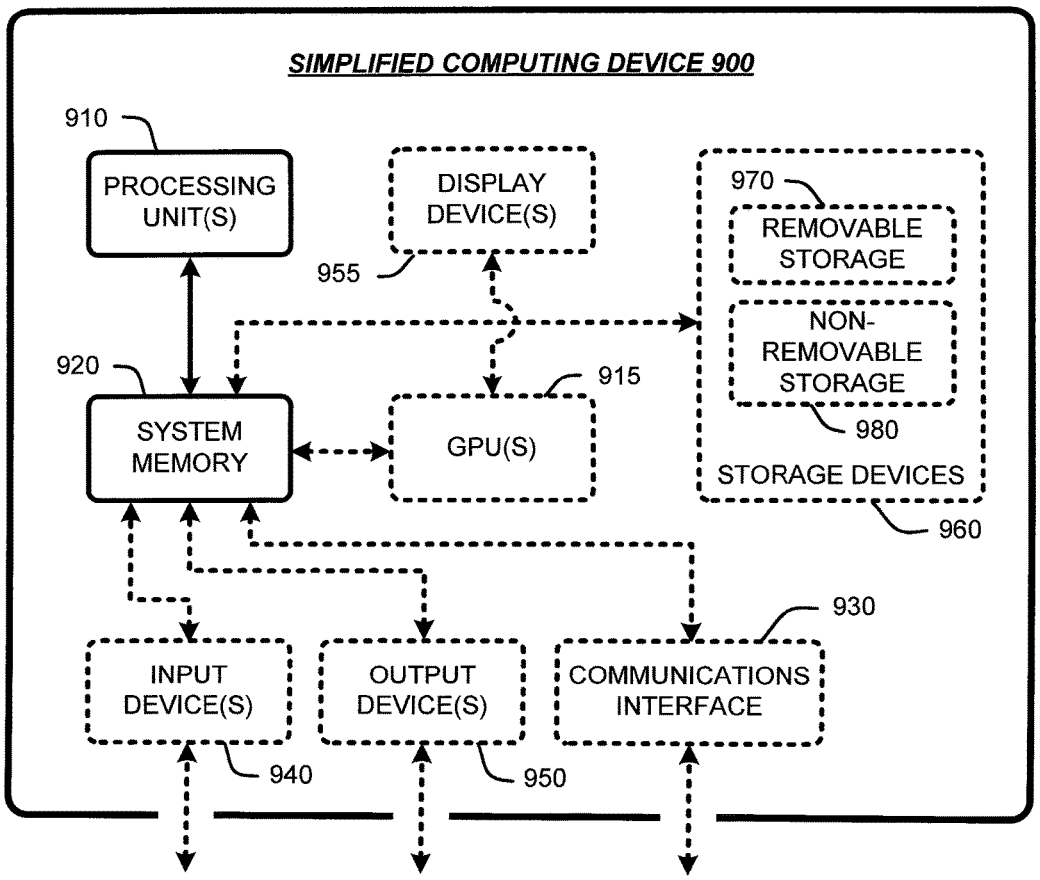
FIG. 9 is an exemplary computing system that can be used with various privacy-preserving energy-efficient speaker implementations described herein.

3.0 Exemplary Operating Environment:

The privacy-preserving energy-efficient speaker implementations described herein are operational within numerous types of general purpose or special purpose computing system environments or configurations. FIG. 9 illustrates a simplified example of a general-purpose computer system on which various elements of the privacy-preserving energy-efficient parametric speaker implementations, as described herein, may be implemented. It is noted that any boxes that are represented by broken or dashed lines in the simplified computing device 900 shown in FIG. 9 represent alternate implementations of the simplified computing device. As described below, any or all of these alternate implementations may be used in combination with other alternate implementations that are described throughout this document.

The simplified computing device 900 is typically found in devices having at least some minimum computational capability such as personal computers (PCs), server computers, handheld computing devices, laptop or mobile computers, communications devices such as cell phones and personal digital assistants (PDAs), multiprocessor systems, microprocessor-based systems, set top boxes, programmable consumer electronics, network PCs, minicomputers, mainframe computers, and audio or video media players.

To allow a device to realize the privacy-preserving energy-efficient speaker implementations described herein, the device should have a sufficient computational capability and system memory to enable basic computational operations. In particular, the computational capability of the simplified computing device 900 shown in FIG. 9 is generally illustrated by one or more processing unit(s) 910, and may also include one or more graphics processing units (GPUs) 915, either or both in communication with system memory 920. Note that that the processing unit(s) 910 of the simplified computing device 900 may be specialized microprocessors (such as a digital signal processor (DSP), a very long instruction word (VLIW) processor, a field-programmable gate array (FPGA), or other micro-controller) or can be conventional central processing units (CPUs) having one or more processing cores and that may also include one or more GPU-based cores or other specific-purpose cores in a multi-core processor.

In addition, the simplified computing device 900 may also include other components, such as, for example, a communications interface 930. The simplified computing device 900 may also include one or more conventional computer input devices 940 (e.g., touchscreens, touch-sensitive surfaces, pointing devices, keyboards, audio input devices, voice or speech-based input and control devices, video input devices, haptic input devices, devices for receiving wired or wireless data transmissions, and the like) or any combination of such devices.

Similarly, various interactions with the simplified computing device 900 and with any other component or feature of the privacy-preserving energy-efficient speaker implementation, including input, output, control, feedback, and response to one or more users or other devices or systems associated with the privacy-preserving energy-efficient speaker implementation, are enabled by a variety of Natural User Interface (NUI) scenarios. The NUI techniques and scenarios enabled by the privacy-preserving energy-efficient speaker implementation include, but are not limited to, interface technologies that allow one or more users user to interact with the privacy-preserving energy-efficient speaker implementation in a "natural" manner, free from artificial constraints imposed by input devices such as mice, keyboards, remote controls, and the like.

Such NUI implementations are enabled by the use of various techniques including, but not limited to, using NUI information derived from user speech or vocalizations captured via microphones or other input devices 940 or system sensors 905. Such NUI implementations are also enabled by the use of various techniques including, but not limited to, information derived from system sensors 905 or other input devices 940 from a user's facial expressions and from the positions, motions, or orientations of a user's hands, fingers, wrists, arms, legs, body, head, eyes, and the like, where such information may be captured using various types of 2D or depth imaging devices such as stereoscopic or time-of-flight camera systems, infrared camera systems, RGB (red, green and blue) camera systems, and the like, or any combination of such devices. Further examples of such NUI implementations include, but are not limited to, NUI information derived from touch and stylus recognition, gesture recognition (both onscreen and adjacent to the screen or display surface), air or contact-based gestures, user touch (on various surfaces, objects or other users), hover-based inputs or actions, and the like. Such NUI implementations may also include, but are not limited to, the use of various predictive machine intelligence processes that evaluate current or past user behaviors, inputs, actions, etc., either alone or in combination with other NUI information, to predict information such as user intentions, desires, and/or goals. Regardless of the type or source of the NUI-based information, such information may then be used to initiate, terminate, or otherwise control or interact with one or more inputs, outputs, actions, or functional features of the privacy-preserving energy-efficient speaker implementation.

However, it should be understood that the aforementioned exemplary NUI scenarios may be further augmented by combining the use of artificial constraints or additional signals with any combination of NUI inputs. Such artificial constraints or additional signals may be imposed or generated by input devices 540 such as mice, keyboards, and remote controls, or by a variety of remote or user worn devices such as accelerometers, electromyography (EMG) sensors for receiving myoelectric signals representative of electrical signals generated by user's muscles, heart-rate monitors, galvanic skin conduction sensors for measuring user perspiration, wearable or remote biosensors for measuring or otherwise sensing user brain activity or electric fields, wearable or remote biosensors for measuring user body temperature changes or differentials, and the like. Any such information derived from these types of artificial constraints or additional signals may be combined with any one or more NUI inputs to initiate, terminate, or otherwise control or interact with one or more inputs, outputs, actions, or functional features of the privacy-preserving energy-efficient speaker implementation.

The simplified computing device 900 may also include other optional components such as one or more conventional computer output devices 950 (e.g., display device(s) 955, audio output devices, video output devices, devices for transmitting wired or wireless data transmissions, and the like). Note that typical communications interfaces 930, input devices 940, output devices 950, and storage devices 960 for general-purpose computers are well known to those skilled in the art, and will not be described in detail herein.

The simplified computing device 900 shown in FIG. 9 may also include a variety of computer-readable media. Computer-readable media can be any available media that can be accessed by the computing device 900 via storage devices 960, and include both volatile and nonvolatile media that is either removable 970 and/or non-removable 980, for storage of information such as computer-readable or computer-executable instructions, data structures, program modules, or other data.

Computer-readable media includes computer storage media and communication media. Computer storage media refers to tangible computer-readable or machine-readable media or storage devices such as digital versatile disks (DVDs), blu-ray discs (BD), compact discs (CDs), floppy disks, tape drives, hard drives, optical drives, solid state memory devices, random access memory (RAM), read-only memory (ROM), electrically erasable programmable read-only memory (EEPROM), CD-ROM or other optical disk storage, smart cards, flash memory (e.g., card, stick, and key drive), magnetic cassettes, magnetic tapes, magnetic disk storage, magnetic strips, or other magnetic storage devices. Further, a propagated signal is not included within the scope of computer-readable storage media.

Retention of information such as computer-readable or computer-executable instructions, data structures, program modules, and the like, can also be accomplished by using any of a variety of the aforementioned communication media (as opposed to computer storage media) to encode one or more modulated data signals or carrier waves, or other transport mechanisms or communications protocols, and can include any wired or wireless information delivery mechanism. Note that the terms "modulated data signal" or "carrier wave" generally refer to a signal that has one or more of its characteristics set or changed in such a manner as to encode information in the signal. For example, communication media can include wired media such as a wired network or direct-wired connection carrying one or more modulated data signals, and wireless media such as acoustic, radio frequency (RF), infrared, laser, and other wireless media for transmitting and/or receiving one or more modulated data signals or carrier waves.

Furthermore, software, programs, and/or computer program products embodying some or all of the various privacy-preserving energy-efficient speaker implementation implementations described herein, or portions thereof, may be stored, received, transmitted, or read from any desired combination of computer-readable or machine-readable media or storage devices and communication media in the form of computer-executable instructions or other data structures. Additionally, the claimed subject matter may be implemented as a method, apparatus, or article of manufacture using standard programming and/or engineering techniques to produce software, firmware 925, hardware, or any combination thereof to control a computer to implement the disclosed subject matter. The term "article of manufacture" as used herein is intended to encompass a computer program accessible from any computer-readable device, or media.

The privacy-preserving energy-efficient speaker implementations described herein may be further described in the general context of computer-executable instructions, such as program modules, being executed by a computing device. Generally, program modules include routines, programs, objects, components, data structures, and the like, that perform particular tasks or implement particular abstract data types. The privacy-preserving energy-efficient speaker implementations may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Additionally, the aforementioned instructions may be implemented, in part or in whole, as hardware logic circuits, which may or may not include a processor.

Alternatively, or in addition, the functionality described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), and so on.

The foregoing description of the privacy-preserving energy-efficient speaker implementations has been presented for the purposes of illustration and description. It is not intended to be exhaustive or to limit the claimed subject matter to the precise form disclosed. Many modifications and variations are possible in light of the above teaching. Further, it should be noted that any or all of the aforementioned alternate implementations may be used in any combination desired to form additional hybrid implementations of the privacy-preserving energy-efficient speaker implementation. It is intended that the scope of the invention be limited not by this detailed description, but rather by the claims appended hereto. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and other equivalent features and acts are intended to be within the scope of the claims.

4.0 Other Implementations

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of detailed description of the privacy-preserving energy-efficient speaker implementation described above.

In regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the foregoing implementations include a system as well as a computer-readable storage media having computer-executable instructions for performing the acts and/or events of the various methods of the claimed subject matter.

There are multiple ways of realizing the foregoing implementations (such as an appropriate application programming interface (API), tool kit, driver code, operating system, control, standalone or downloadable software object, or the like), which enable applications and services to use the implementations described herein. The claimed subject matter contemplates this use from the standpoint of an API (or other software object), as well as from the standpoint of a software or hardware object that operates according to the implementations set forth herein. Thus, various implementations described herein may have aspects that are wholly in hardware, or partly in hardware and partly in software, or wholly in software.

The aforementioned systems have been described with respect to interaction between several components. It will be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (e.g., hierarchical components).

Additionally, it is noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

The following paragraphs summarize various examples of implementations which may be claimed in the present document. However, it should be understood that the implementations summarized below are not intended to limit the subject matter which may be claimed in view of the foregoing descriptions. Further, any or all of the implementations summarized below may be claimed in any desired combination with some or all of the implementations described throughout the foregoing description and any implementations illustrated in one or more of the figures, and any other implementations described below. In addition, it should be noted that the following implementations are intended to be understood in view of the foregoing description and figures described throughout this document.

Various privacy-preserving energy-efficient speaker implementations are by means, systems processes or techniques for maintaining privacy while a user is listening to audio and reducing the energy consumption of a transducer while outputting the audio. As such some privacy-preserving energy-efficient speaker implementations have been observed to improve user privacy and reduce energy consumption typically required to output audio signals. Additionally, some implementations allow for the device transmitting the device to be made smaller.

As a first example, in various implementations, a process for maintaining privacy while a user is listening to audio is provided via means, processes or techniques for dividing an audio signal representative of sound to be heard by the ear of the user into multiple complementary parts. In various implementations the process then outputs one or more parts of the audio signal to one channel, while outputting one or more parts of the audio signal to other channels so that sound generated by all parts of the audio signal arrive at the ear of the user at or about the same time.

As a second example, in various implementations, the first example is further modified via means, processes or techniques such that the audio signal is split by, for each frame of an audio signal: computing which part of the frame is below a maximum power that can be sent to a given channel by adding the power spectrum for frequencies in the frame until the maximum power that can be sent to the given channel is reached for that frame; and sending frequencies under the maximum power that can be sent to the given channel to the given channel. The rest of the signal is sent to one or more of the other channels.

As a third example, in various implementations, any of the first example and the second example are further modified via means, processes or techniques by sending one or more parts of the audio signal to one or more parametric speakers.

As a fourth third example, in various implementations, the third example is further modified via means, processes or techniques such that the one or more parts of the audio signal that are sent to the one or more parametric speakers are sent by modulating ultrasonic carrier signals by the audio signal, and a low frequency signal with a minimal spectral power above a frequency that a human can hear is added to the modulated ultrasonic carrier signals.

As a fifth example, in various implementations, any of the first example, the second example, the third example, and the fourth example are further modified via means, processes or techniques for delaying the modulated signals based upon computed delay coefficients so as to arrive at the ear of the user at or about the same time.

As a sixth example, in various implementations, any of the third example, the fourth example, and the fifth example, are further modified via means, processes or techniques for sending high frequency parts of the audio signal to the one or more parametric speakers.

As a seventh example, in various implementations, any of the first example, the second example, the third example, the fourth example, the fifth example, and the sixth example, are further modified via means, processes or techniques for outputting a masking sound directed to locations other than the ear of the user.

As an eighth example, in various implementations, any of the first example, the second example, the third example, the fourth example, the fifth example, the sixth example, and the seventh example, are further modified via means, processes or techniques for sending one or more parts of the audio signal to one or more loudspeakers.

As a ninth example, in various implementations, the eighth example is further modified via means, processes or techniques for sending low frequency parts to the one or more loudspeakers.

As a tenth example, in various implementations, any of the first example, the second example, the third example, the fourth example, the fifth example, the sixth example, the seventh example, the eighth example and the ninth example are further modified via means, processes or techniques for splitting the audio signal so that particular phonemes in speech are particularly distorted when output to a particular channel.

As an eleventh example, in various implementations, a computer-implemented process is provided via means, processes or techniques for modulating a signal in order to reduce energy consumption of a transducer. In various implementations the computer-implemented process adds a low frequency signal to the signals to be transmitted in a manner so as to reduce energy required to output the audio signal. In various implementations, the computer-implemented process then modulates carrier signals by a signal representative of sound to be heard by the ear of a user.

As a twelfth example, in various implementations, the eleventh example is further modified via means, processes or techniques so that the carrier signals are ultrasonic carrier signals.

As a thirteenth example, in various implementations, the eleventh example is further modified via means, processes or techniques so that the carrier signals are radio frequency signals and the modulation process uses amplitude modulation, with or without carrier suppression.

As a fourteenth example, in various implementations, any of the eleventh example, the twelfth example and the thirteenth example are further modified via means, processes or techniques by adding a low frequency signal to the signal to be transmitted so that for one or more segments of the signal, a first negative amplitude sample in a segment of the audio signal is found; and a window signal or a positive signal centered around the most negative amplitude sample is added to reduce the number of negative samples in the segment and to determine an envelope for the modulated carrier signals.

As a fifteenth example, in various implementations, any of the twelfth example, the thirteenth example, and the fourteenth example, are further modified via means, processes or techniques so that the window signal is a Hanning window signal.

As a sixteenth example, in various implementations, any of the twelfth example, the thirteenth example, the fourteenth example, and the fifteenth example, are further modified via means, processes or techniques so that the window or positive signal is an asymmetric window signal.

As a seventeenth example, in various implementations, any of the twelfth example, the thirteenth example, the fourteenth example, the fifteenth example, and the sixteenth example, are further modified via means, processes or techniques for adding a low frequency signal to the signal to be transmitted by using a rectifier to rectify any negative portion of the audio signal, using a low pass filter on the rectified audio signal to determine an envelope for the modulated carrier signals; and adding a low frequency signal to the audio signal so that the low frequency signal pushes the envelope to be always positive or within a determined desired range.

As an eighteenth example, in various implementations, a system for providing audio to a user while maintaining privacy is provided via means, processes or techniques for applying a computing device and a computer program comprising program modules executable by the computing device that direct the computing device to divide an audio signal into two complementary parts, a first part and a second part. The first part of the audio signal is output using a parametric speaker, by generating ultrasonic carrier signals; generating modulated signals by modulating the ultrasonic carrier signals by the first part of the audio signal and adding a low frequency signal to the modulated signals; transmitting the modulated signals to transducers of the parametric speaker causing the transducers to form an ultrasonic beam that has a main lobe directed towards the ear of the user. The second part of the audio signal is output using one or more loudspeakers so that the sound output by the one or more loudspeakers reaches the user at or about the same time the ultrasonic beam reaches the user.

As a nineteenth example, in various implementations, the eighteenth example is further modified via means, processes or techniques for determining the location of a user's ear by head tracking.

As a twentieth example, in various implementations, any of the eighteenth example, and the nineteenth example are further modified via means, processes or techniques for using two parametric speakers to output the first part of the audio signal, one directed at the left ear of the user and one directed at the right ear of the user, and wherein the shape of the user's head is used to separate sound sent to the left ear and the right ear of the user from the two parametric speakers.

What is claimed is:

1. A computer-implemented process for maintaining privacy while a user is listening to audio, comprising:

dividing an audio signal representative of sound to be heard by the ear of the user into multiple complementary parts; and sending one or more parts of the multiple complementary parts of the audio signal to a first channel, while sending one or more other parts of the multiple complementary parts of the audio signal to channels other than the first channel in a manner so that sound generated by the one or more parts of the multiple complementary parts of the audio signal and the one or more other parts of the multiple complementary parts of the audio signal arrive at the ear of the user at substantially the same time, wherein the one or more parts of the multiple complementary parts of the audio signal sent to the first channel are sent to one or more parametric speakers, and wherein the one or more parts of the multiple complementary parts of the audio signal that are sent to the one or more parametric speakers are sent by modulating ultrasonic carrier signals by the one or more parts of the multiple complementary parts of the audio signal added with a low frequency signal with a minimal spectral power above a lowest frequency that a human can hear.

2. The computer-implemented process of claim 1, wherein the dividing of the audio signal further comprises:

for each frame of the audio signal:

computing which part of the frame is below a maximum power that can be sent to a given channel;

adding a power spectrum for frequencies in the part of the frame until the maximum power is reached for that frame; and sending the part with the added power spectrum of the frame for the frequencies as the one or more parts of the multiple complementary parts in the frame of the audio signal to the given channel as the first channel, and sending a rest of the frequency components of the frame of the audio signal as the one or more other parts of the multiple complementary parts of the audio signal that are not sent to the given channel, to one or more of the other channels so that the one or more parts and the one or more other parts of the multiple complementary parts of the audio signal arrive at the ear of the user at substantially the same time.

3. The computer-implemented process of claim 1 wherein the one or more other parts of the multiple complementary parts of the audio signal sent to channels other than the first channel are sent to one or more loudspeakers.

4. The computer-implemented process of claim 3, wherein the modulated audio signal with the low frequency signal added reduces the energy consumption of the one or more parametric speakers to output the modulated audio signal with the low frequency signal added.

5. The computer-implemented process of claim 1, wherein the modulated signals are delayed based upon computed delay coefficients so as to arrive at the ear of the user at substantially the same time.

6. The computer-implemented process of claim 1 wherein high frequency parts of the audio signal are sent via one or more channels to the one or more parametric speakers.

7. The computer-implemented process of claim 1, further comprising outputting a masking sound directed to locations other than the ear of the user.

8. The computer-implemented process of claim 1 wherein the one or more other parts of parts of the multiple complementary parts of the audio signal sent to the channels other than the first channel are sent to one or more loudspeakers.

9. The computer-implemented process of claim 8 wherein the one or more other parts of the multiple complementary parts of the audio signal sent to the one or more loudspeakers are low frequency parts of the audio signal.

10. The computer-implemented process of claim 1, further comprising splitting the audio signal so that particular phonemes in speech are particularly distorted when sent to a particular channel.

11. A computer-implemented process for modulating a signal in order to reduce energy consumption of a transducer comprising:

adding a low frequency signal with an unsubstantial spectral power above a lowest frequency that a human can hear to an audio signal to be transmitted in a manner so as to reduce energy required to output the audio signal, wherein the audio signal is representative of sound to be heard by a user; and modulating carrier signals by the audio signal with the low frequency signal added; and outputting the modulated audio signal with the low frequency signal added by the transducer in order to reduce the energy consumption of the transducer.

12. The computer-implemented process of claim 11 wherein the carrier signals are ultrasonic carrier signals.

13. The computer-implemented process of claim 11 wherein the carrier signals are radio frequency signals and the modulation process uses amplitude modulation, with or without carrier suppression.

14. The computer-implemented process of claim 11 wherein adding a low frequency signal to the audio signal to be transmitted further comprises:

for one or more segments of the audio signal, finding a first negative amplitude sample in a segment of the audio signal;

adding a window or a positive signal centered around the most negative amplitude sample of the audio signal to reduce the number of negative samples in the segment and to determine an envelope for the modulated carrier signals.

15. The computer-implemented process of claim 14 wherein the window signal is a Hanning window signal.

16. The computer-implemented process of claim 14 wherein the window signal is an asymmetric window signal.

17. The computer-implemented process of claim 11 wherein adding a low frequency signal to the audio signal to be transmitted further comprises:

using a rectifier to rectify any negative portion of the audio signal, using a low pass filter on the rectified audio signal to determine an envelope for the modulated carrier signals; and adding a low frequency signal to the audio signals so that the low frequency signal pushes the envelope to be always positive or within a determined desired range.

18. A system for providing audio to a user while maintaining privacy, comprising:

a computing device;

a computer program comprising program modules executable by the computing device, wherein the computing device is directed by the program modules of the computer program to, divide an audio signal into two complementary parts, a first part and a second part;

output the first part of the audio signal using a parametric speaker, comprising:

generating ultrasonic carrier signals;

adding a low frequency signal with a minimal spectral power above a lowest frequency that a human can hear to the first part of the audio signal;

generating modulated signals by modulating the ultrasonic carrier signals by the first part of the audio signal added with the low frequency signal;

transmitting the generated modulated signals to transducers of the parametric speaker and causing the transducers to form an ultrasonic beam that has a main lobe directed towards the ear of the user; and output the second part of the audio signal using one or more loudspeakers so that the sound output by the one or more loudspeakers is directed toward the ear of the user.

19. The system of claim 18 wherein a location of the user's ear is determined by using head tracking.

20. The system of claim 18 wherein two parametric speakers are used to output the first part of the audio signal, one directed at the left ear of the user and one directed at the right ear of the user, and wherein the shape of the user's head is used to separate sound sent to the left ear and the right ear of the user from the two parametric speakers.

* * * * *